United States Patent [19]

Harding

[11] Patent Number: 4,615,457

[45] Date of Patent: Oct. 7, 1986

[54] DISPOSABLE COMBINATION LID AND STRAW FOR CONTAINERS

[76] Inventor: Richard D. Harding, P.O. Box 2134, Merrifield, Va. 22116

[21] Appl. No.: 776,521

[22] Filed: Sep. 16, 1985

[51] Int. Cl.[4] ..... A47G 19/22; B65D 57/00

[52] U.S. Cl. ..... 220/90.2; 220/90.4; 222/539; 229/75

[58] Field of Search ..... 220/90.2, 90.4; 229/75; 222/520, 528, 530, 539, 534, 535

[56] References Cited

U.S. PATENT DOCUMENTS

| | | | |
|---|---|---|---|
| 2,052,496 | 8/1936 | Stassi . | |
| 2,724,536 | 11/1955 | Pugh, Sr. | 229/7 S |
| 2,837,234 | 6/1958 | Mainiere . | |
| 2,844,267 | 7/1958 | Petriccione . | |
| 2,948,453 | 8/1960 | Drown | 220/90.4 X |
| 3,172,561 | 3/1965 | Schwartz | 220/90.2 |
| 3,181,747 | 5/1965 | Grobowski | 222/539 |
| 3,547,308 | 12/1970 | Gilliem | 220/90.2 |
| 3,863,817 | 2/1975 | Speaker | 222/530 |
| 4,194,674 | 3/1980 | Pearson . | |
| 4,247,016 | 1/1981 | Shaw | 220/90.2 |
| 4,291,814 | 9/1981 | Conn | 220/90.4 |
| 4,428,498 | 1/1984 | Obey | 220/90.4 X |

*Primary Examiner*—Steven M. Pollard
*Attorney, Agent, or Firm*—Henderson & Sturm

[57] ABSTRACT

A flexible plastic removable lid apparatus for a disposable glass or cup having a horizontally disposed circular member constructed of a semi-rigid flexible plastic material. The edges of the circular member have an annular downwardly depending flange attached thereto for extending over the edge of such glass or cup. An upper tubular connector is connected to the central top portion of the circular member and a lower short tubular connector member is connected to the bottom central portion of the circular member. These two tubular connector members are in fluid communication with each other. A first upper straw is glued in an arcuate position to the top of the circular member and this upper straw can be removed and placed on the upper connector member to produce an upper straw section. Similarly a lower straw member is glued to the bottom of the circular member and it can be removed therefrom when necessary to frictionally and sealingly fit on the lower tubular connector member to thereby produce a combination lid and straw which extends into the liquid within the cup and extends upwardly so that a person can suck the liquid out through the straw. Arrangement of the upper straw as it is glued to the top of the circular member form is in a smaller arc while the position of the straw is formed in a larger arc on the lower straw. Additionally, the upper tubular connector member is larger than the lower tubular connector member so that these combination lids and straws can be stacked one on top of the other in a compact fashion.

5 Claims, 8 Drawing Figures

DISPOSABLE COMBINATION LID AND STRAW FOR CONTAINERS

TECHNICAL FIELD

The present invention relates generally to a combination lid and straw for use in the carry out beverage industry and more particularly to such a combination for the purpose of saving waste and saving space.

BACKGROUND ART

Typically, soft drinks or the like served in fast food establishments and in many other places utilize plastic lids for preventing the contents of such container from spilling. Such lid normally has an opening therein for reception of a straw therethrough. One of the problems with this very common product, from the point of view of the vendor of such soft drinks or the like, is that quite often the customers take more than one straw per drink and this results in a great additional expense to the vendor. Even when the customer leaves such extra straws behind, they cannot be reused because of the danger that they would not be clean and sanitary once handled by the customers.

Consequently there is a need for an apparatus or method for preventing the aforementioned type of waste in order to control the amount and number of straws utilized by soft drink customers.

DISCLOSURE OF THE INVENTION

The present invention relates generally to a flexible plastic removable lid apparatus for a disposable glass or cup having a horizontally disposed circular member constructed of a semi-rigid flexible plastic material. The edges of the circular member have an annular downwardly depending flange attached thereto for extending over the edge of such glass or cup. A vent or hole extends through a portion of the circular member so that suction forces do not interfere with the proper use of the device. An upper tubular connector is connected to the central top portion of the circular member and a lower short tubular connector member is connected to the bottom central portion of the circular member. These two tubular connector members are in fluid communication with each other. A first upper straw is glued in an arcuate position to the top of the circular member and this upper straw can be removed and placed on the upper connector member to produce an upper straw section. Similarly a lower straw member is glued to the bottom of the circular member and it can be removed therefrom when necessary to frictionally and sealingly fit on the lower tubular connector member to thereby produce a combination lid and straw which extends into the liquid within the cup and extends upwardly so that a person can suck the liquid out through the straw. Arrangement of the upper straw as it is glued to the top of the circular member form is in a smaller arc while the position of the straw is formed in a larger arc on the lower straw. Additionally the upper tubular connector member is larger than the lower tubular connector member so that these combination lids and straws can be stacked one on top of the other in a compact fashion; that is, the upper and lower tubular connector members of adjacent lids will telescope together and similarly the upper and lower straws will nest beside each other.

An object of the present invention is to provide an improved combination lid and straw apparatus of a disposable type.

Another object of the present invention is to provide a combination lid and straw apparatus for soft drinks or the like in which waste can be easily controlled.

A further object of the present invention is to provide a combination lid and straw of a disposable type which is easily nestable together so that they can be stored or shipped in a very compact fashion.

Other objects, advantages, and novel features of the present invention will become apparent from the following detailed description of the invention when considered in conjunction with the accompanying drawings.

BRIEF DESCRIPTION OF THE DRAWINGS

FIG. 6 is a cross sectional view of the present invention shown in use in attachment to a soft drink cup or the like;

BEST MODE FOR CARRYING OUT THE INVENTION

Figure 1:
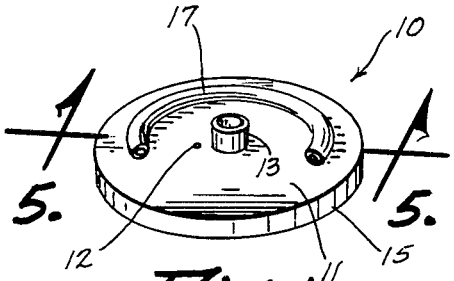
FIG. 1 is a perspective view from the top of a combination lid and straw constructed in accordance with the present invention.
Figure 2:
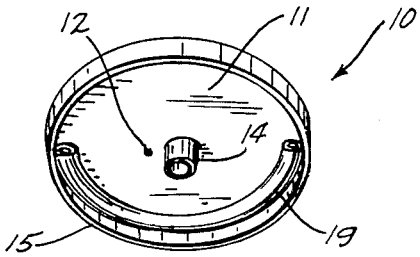
FIG. 2 is a perspective view of the present invention as viewed from below.

Referring now to the drawings wherein like reference numerals designate identical or corresponding parts throughout the several views, FIG. 1 shows a combination straw and lid device (10) constructed in accordance with the present invention. The device (10) has a generally circular member (11) which is made of semi-rigid but yet flexible plastic of a type commonly found in fast food establishments and used as lids for soft drinks there. The circular member (11) has an opening (12) therein for preventing a vacuum from forming when the apparatus is in use.

Figure 5:
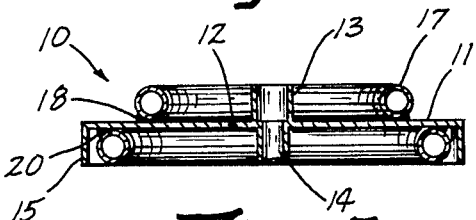
FIG. 5 is a cross sectional view taken along line 5—5 of FIG. 1.

An upper tubular connector member (13) is formed integrally with the circular member (11) and a lower tubular connector member (14) extends downwardly from the center of the circular member (11). Referring to FIG. 5 it is noted that the upper tubular member (13) is larger in diameter than the lower tubular member (14) for reasons which will be explained below.

Figure 3:
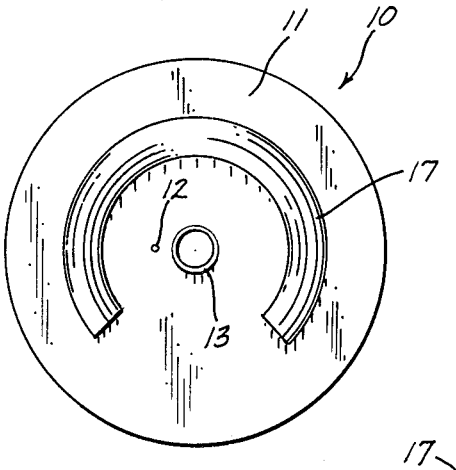
FIG. 3 is a top plan view of the preferred embodiment of the present invention.
Figure 4:
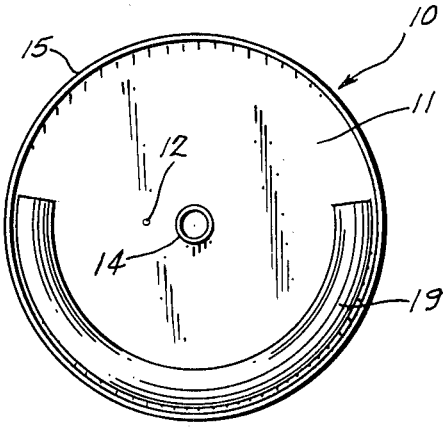
FIG. 4 is a bottom plan view of the preferred embodiment of the present invention.
Figure 6:
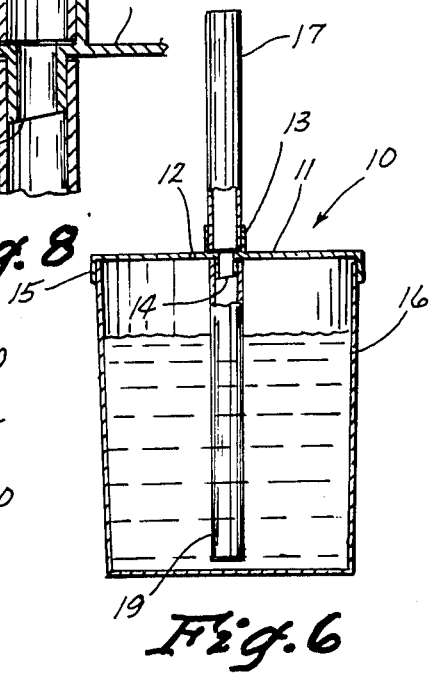

An annular downwardly depending flange (15) is connected around the outer periphery of this circular member (11) for extending over the top edge of a cup (16) as shown in FIG. 6. An upper straw member (17) is additionally glued in an arcuate position, for example as shown in FIG. 3, by a non-toxic adhesive of a type approved by the Federal Department of Agriculture. Similarly, a lower tubular straw (19) is glued in place, for example the position shown in FIGS. 4 and 5, by a similar adhesive (20).

Figure 7:
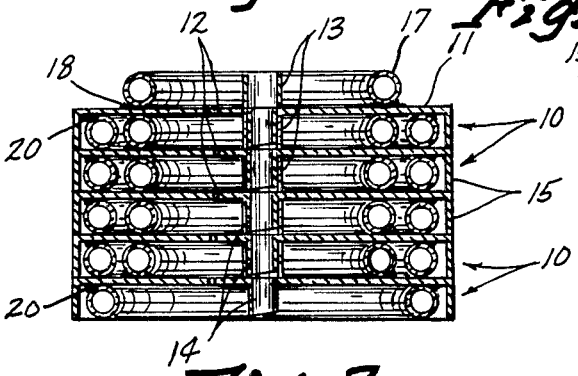
FIG. 7 shows a plurality of the combination lid and straw devices in a stacked condition.

A plurality of the structures shown in FIG. 5 can be stacked together, for example as shown in FIG. 7, wherein the lower tubular connector member (14) is of a size that it can fit down into the top of an upper tubular member (13) when one of the devices (10) is stacked upon the other. Similarly, the upper straw member (17) is in a smaller tighter arc than the lower straw member (19) so that when these devices (10) are stacked in the position shown in FIG. 7, the lower straw connected to the bottom of one of the devices (10) extends around the outside and beside an upper straw connected to such a device (10) disposed directly and in telescoping relationship with such other apparatus (10).

It will be appreciated from viewing FIG. 7 that the devices (10) can be made to be very compact for shipping purposes and for storage purposes. When it is desired to use one of the devices (10) shown in FIG. 7, it would merely be unstacked off the top of the stack shown in FIG. 7, at which time the upper and lower straw members (17) and (19) respectively would be detached from the circular member (11) by merely pulling it off of such circular member (11). The adhesive (18) and (20) would be applied only in an amount necessary to keep the respective straws (17) or (19) attached to the circular member (11) in the stacked condition, but not so much adhesive would be used to prevent the straws (17) or (19) from being manually separated from the circular member (11).

Figure 8:
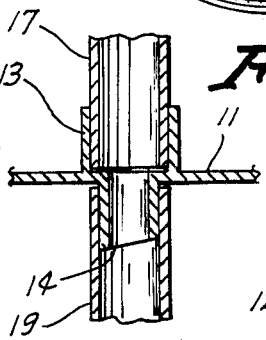
FIG. 8 is an enlarged cross sectional view similar to FIG. 6 but showing how the top straw telescopes inside of the top tubular member and the bottom straw telescopes outside of the lower tubular connector member.

Once the upper and lower straws are removed, then the lower straw can be telescoped over the lower connector member (14), for example as shown in FIG. 8 and similarly, the upper straw member (17) can be telescoped inside of the upper tubular connector member (13), for example as shown in FIG. 6 and 8. The entire combination lid and straw structure (10), when it is so assembled as shown in FIG. 6, can then be placed on top of a soft drink container (16) or the like.

Accordingly, it will be appreciated that the preferred embodiment disclosed herein does indeed accomplish the aforementioned objects. Obviously many modifications and variations of the present invention are possible in light of the above teachings. It is therefore to be understood that, within the scope of the appended claims, the invention may be practiced otherwise than as specifically described.

I claim:

1. A flexible plastic removable lid apparatus for a glass or cup comprising:

a horizontally disposed circular member constructed of a semi-rigid flexible plastic material;

an annular downardly depending member attached to the outer periphery of said circular member;

a vent hole disposed in said circular member;

a lower tubular straw attached to a lower portion of said circular member;

an upper tubular connector member integrally attached to central portion of said circular member, said upper tubular member being in fluid communication with the top of said lower tubular straw;

and upper tubular straw in telescoping relationship with said upper tubular connector member for permitting said upper tubular straw to be detachable, said upper tubular straw being of a diameter to frictionally engage said upper tubular connector member to hold and seal the upper tubular straw to the upper tubular connector member; and means for detachably connecting said lower tubular straw to said circular member, said connecting means comprising a lower short tubular connector member integrally attached to the upper short tubular connector member, said lower short tubular connector member being of a diameter to frictinally and sealably engage said lower tubular straw in a telescoping relationship, said lower short tubular connector member being of a different size than the upper short tubular connector whereby one lid appartus will stock onto another lid apparatus wherein upper tubular connector on one lid apparatus will be in a compact telescoping relationship with the lower tubular connector on said another lid appparatus.

2. The lid apparatus of claim 1 including means for removably attaching said upper tubular straw to the top of said circular member in an arcuate position.

3. The lid apparatus of claim 2 said attaching means comprises a Federal Department of Agriculture approved non-toxic adhesive material.

4. The lid apparatus of claim 3 including non-toxic glue means for removably attaching said lower tubular straw to the lower side of said circular member in an arcuate position.

5. The lid apparatus of claim 4 the arcuate position of the lower tubular straw is sufficiently different than the arcuate position of the upper tubular straw so that when such lid apparatuses are stacked together, the upper tubular straw on the lower one of such lid apparatus will lie beside the lower tubular straw on the upper one of such lid apparatus.

* * * * *